US008840263B1

(12) United States Patent
Jones

(10) Patent No.: US 8,840,263 B1
(45) Date of Patent: Sep. 23, 2014

(54) SAFETY LIGHT

(71) Applicant: Henry Franklin Jones, Pleasanton, CA (US)

(72) Inventor: Henry Franklin Jones, Pleasanton, CA (US)

( * ) Notice: Subject to any disclaimer, the term of this patent is extended or adjusted under 35 U.S.C. 154(b) by 0 days.

(21) Appl. No.: 13/754,903

(22) Filed: Jan. 31, 2013

(51) Int. Cl.
*F21V 21/00* (2006.01)

(52) U.S. Cl.
CPC ..... *F21L 15/08* (2013.01)
USPC ..... 362/108; 362/231

(58) Field of Classification Search
USPC ..... 362/103, 108, 231; 2/310
See application file for complete search history.

(56) References Cited

U.S. PATENT DOCUMENTS

| | | | | |
|---|---|---|---|---|
| 4,328,533 | A | 5/1982 | Paredes | |
| 4,709,307 | A | 11/1987 | Branom | |
| 4,924,362 | A * | 5/1990 | Janko et al. | 362/108 |
| 5,434,759 | A * | 7/1995 | Endo et al. | 362/108 |
| 5,779,348 | A * | 7/1998 | Interlicchio | 362/108 |
| 5,984,488 | A * | 11/1999 | Tung | 362/108 |
| 6,059,414 | A * | 5/2000 | Tsai | 359/516 |
| 6,267,482 | B1 * | 7/2001 | Miller et al. | 362/103 |
| 6,517,214 | B1 * | 2/2003 | Mitchell et al. | 362/108 |
| 6,611,244 | B1 | 8/2003 | Guritz | |
| 6,970,090 | B1 * | 11/2005 | Sciarra | 340/573.1 |
| 6,997,573 | B2 | 2/2006 | Maese | |
| 7,244,045 | B2 * | 7/2007 | Schrimmer et al. | 362/555 |
| D654,249 | S | 2/2012 | Stout | |
| 8,408,731 | B1 * | 4/2013 | Joyner | 362/108 |
| 2006/0291193 | A1 | 12/2006 | Hill | |
| 2007/0081324 | A1 * | 4/2007 | Schrimmer et al. | 362/103 |
| 2007/0291473 | A1 * | 12/2007 | Traynor | 362/106 |
| 2008/0067202 | A1 | 3/2008 | Silva | |
| 2008/0080172 | A1 | 4/2008 | Mayo | |
| 2008/0117624 | A1 | 5/2008 | Kirkov | |
| 2009/0122526 | A1 | 5/2009 | Lei | |
| 2009/0134992 | A1 | 5/2009 | Pacheco | |
| 2009/0284961 | A1 | 11/2009 | Shemwell | |
| 2011/0038142 | A1 | 2/2011 | Ritter | |
| 2011/0075401 | A1 | 3/2011 | Torres | |
| 2012/0002402 | A1 | 1/2012 | Finn | |
| 2012/0002403 | A1 | 1/2012 | Winzer | |
| 2012/0033411 | A1 | 2/2012 | Heo | |

* cited by examiner

*Primary Examiner* — Laura Tso
(74) *Attorney, Agent, or Firm* — Kim Rubin, Patent Agent

(57) ABSTRACT

A device and method to enhance the visibility and thus the safety of users of open conveyances, such as motorcycle riders, bicyclists, skiers, and the like, is described. The device comprises one or more long, flexible strips containing LEDs or another light source inside of a long, transparent, flexible tube. The tube is worn around the torso that it passes over both shoulders, crosses in the back, and is fastened in the front so that both ends and also the center of tube are secure against the torso. A controller and power source options are provided, in various embodiments, includes ones that use a smart phone and the like, and synchronize multiple users, to cause the illuminated strips to light in a sequence of light, or patterns, wherein these light sequences are visible from all sides of the user.

19 Claims, 9 Drawing Sheets

SAFETY LIGHT

BACKGROUND OF THE INVENTION

Over 4000 motorcycles deaths occur per year in the US. In many cases a driver hits a motorcyclist that he did not see, or did not see soon enough. Motorcyclists and inventors have come up with a variety of ways to improve the visibility of motorcyclists.

In patent U.S. Pat. No. 4,328,533 Paredes describes an illuminated safety garment. Indeed, the prior art includes a large number of "safety vests" designed to improve the visibility of motorcycle riders. Paredes teaches a complex and cumbersome vest that supports flashing light bulbs on the shoulders. This invention has a first weakness in being a garment, in this case a vest, which must be worn over other clothing. A motorcyclist may not wish to wear a particular article of clothing for a variety of reasons: it may not fit properly; it may interfere with movement; it may not be comfortable; or it may not be compatible with the appearance the biker wishes to project. Paredes' illuminated safety garment suffers from a second weakness in that it is not visible from all directions; and a third weakness that its flashing light bulbs are not visually unique on a visually complex roadway; and a fourth weakness that it requires batteries to operate.

In patent U.S. Pat. No. 4,709,307 Branom describes clothing with a message or pattern. Branon's clothing is primarily for advertising, not for safety. Branom teaches a multi-layer garment with holes through which LEDs may shine. This garment suffers from a fixed message that is not sufficient to assure the attention of other motorists. In addition, this clothing is not legal wear for motorcyclists in all locations.

In patent U.S. Pat. No. 6,517,214 Mitchell et al. describe a vest for hunting. A first weakness of this device is that it is not visible from all directions. A second weakness is that, as a vest, it is an article of clothing that must be worn outermost. A third weakness is that this article is not resistant to abrasion from falls. As described, this vest does not provide sufficient visibility for daytime use.

In patent U.S. Pat. No. 6,611,244 Guritz describes an item that may be either jewelry or a safety device, which produces a pattern of light. Guritz teaches a "small" device that may be worn as "a bracelet, necklace rings, earrings or other relatively small decorative jewelry item," and is thus not suitable for visibly and uniquely identifying a motorcyclist to another driver in the daytime.

In U.S. Pat. No. 6,997,573 Maese teaches a luminescent vest. This invention suffers from a first weakness as an article of clothing that must be worn outermost. It suffers from a second weakness that it must be wired to the motorcycle. It suffers a third weakness that it is not particularly visible in the daytime.

Motorcyclists are not the only users of open conveyances who risk injury or death because of low visibility. Over 50,000 bicyclists are injured each year.

SUMMARY OF THE INVENTION

This invention overcomes many of the weaknesses of prior art. It may be easily worn by the users of a variety of open conveyances, not just motorcyclists. It does not require a connection to the electrical system of the host vehicle. It is not a garment, and thus it does not interfere with the comfort and appearance of a biker. It is waterproof and abrasion resistant, and thus suitable for extended use by a motorcycle rider. It is bright and provides unique visible light patterns and sequences, providing clear, unique visibility to a motorcycle rider in the daytime. It is visible from all sides.

In one embodiment, this invention comprises a long, flexible light-emitting source, such as a strip of multi-color LEDs, placed inside a rugged, flexible, transparent tube. Two such light-emitting strips may be used back-to-back to assure visibility from all sides, or, a single strip may be folded in half so that each half is back-to-back in the tube. The tube is capped at the ends and placed around the torso and over the shoulders such that is both comfortable and highly visible from all sides. The ends of the tube are fastened together near the chest, then a second fastener secures the connected ends to the center of the tube in the front of the torso, creating a fit on the torso sufficiently firm to keep the tube from flapping in use, yet loose enough to allow easy movement. Connection to a controller and power source is provided via one of the ends or via one of the fasteners.

In one embodiment, the power source may be either a local battery pack or a power connection to a separate power source, such as a motorcycle. This flexibility to the rider is by this feature is particularly important. For short trips, or trips on a bike that is not configured to provide power, a mobile battery, self-contained, or internal to the controller or internal to the tube, powers the device. For long road trips, continuous power is assured by a connection to the bike's power system. A battery may be integrated with one or more of the fasteners. The batteries, fasteners, and controller may be integrated into a single physical component.

Different embodiments provide different controllers and controller configurations. Some controllers permit the driver to easily change to a different illumination pattern via a single button or touch, for example, while driving. Some controllers permit multiple devices on multiple riders, who are riding as a group, to display identical or coordinated illumination sequences. One controller may control more than one device. Some controllers permit a variety of illumination patterns to be selected in advance. Some controllers permit on-vehicle control by a personal electronic device. This allows an "app," for example, to control the lighting of this invention responsive to a wide variety of variables.

One such variable might be location or input from an accelerometer. For example, when a biker is braking, or about to make a left turn, or revving his engine, or changing gears, a particular illumination pattern or sequence is shown.

An important improvement over prior art is the characteristic that this invention is not a garment. In addition to the issues of comfort and fit, many bikers wish to present a particular image, and that image may not be that of "government worker wearing a safety vest." This invention permits a biker to wear whatever outer-garment he wishes, such as an outer-garment with a club logo, for example, yet be clearly visible so as to live.

DETAILED DESCRIPTION

Figure 1:
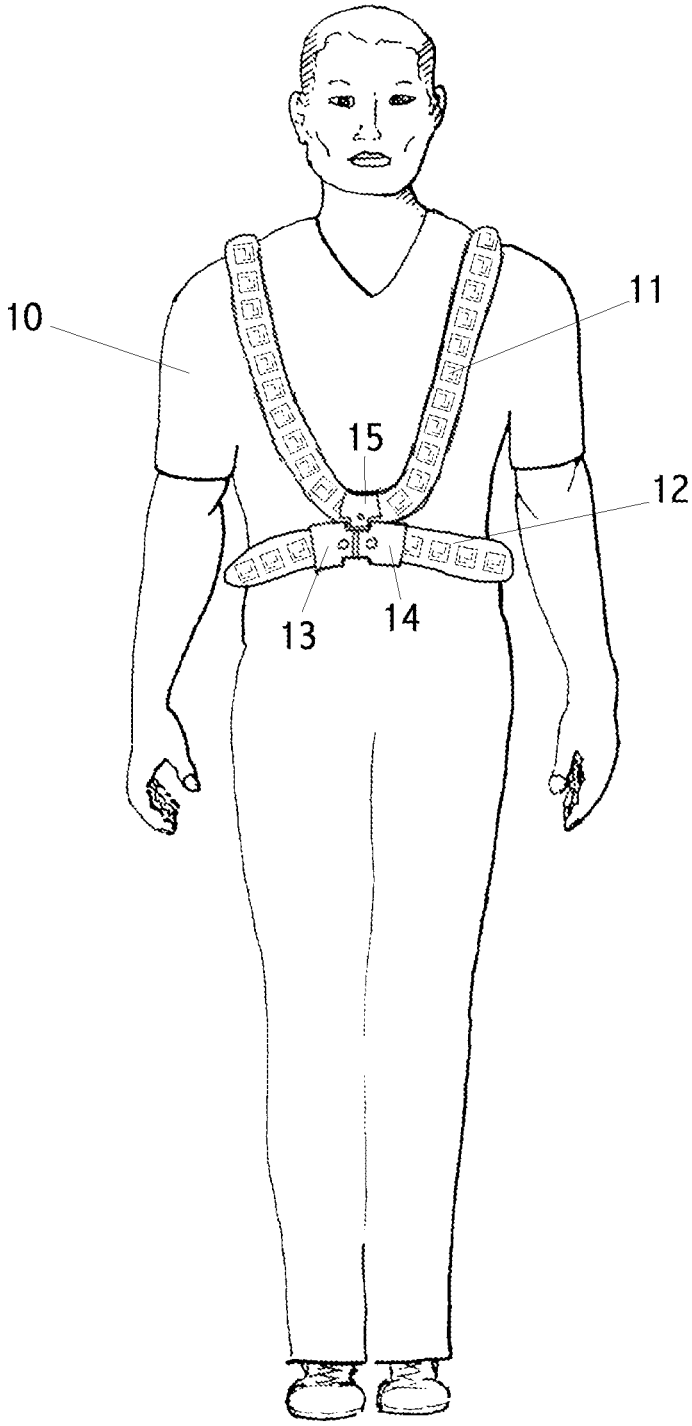
FIG. 1 is an exemplary view of the invention as a front view of a person.

FIG. 1 shows a person 10 wearing one embodiment of the invention. This invention is designed to be used by users of open conveyances. Non-limiting examples include: a motorcycle driver, a motorcycle passenger, a bicyclist, a skateboarder, a sailboarder, a scooter or moped driver or passenger, a hang-glider user, paraglider, bungee-jumper or skydiver, a skier or snowboarder, and a person pushing a stroller. We show a user 10 standing in FIG. 1, rather than the user on his selected open conveyance, for generality. The embodiment of the invention is generally designed to snake around a user's torso 10, as shown in the Figure. As worn in this view, the first end 13 starts near the stomach in front of the user, then wraps around back, crossing the back diagonally to come to the front over the opposite, first shoulder; hanging in a U shape 11 down the front of the torso; going over the second shoulder, across the back diagonally in the second diagonal, then around the front, 12, so the second end 14 is proximal to the first end 13.

Other wearing configurations of embodiments are possible. A first variation is to reverse the above configuration front to back, so the fasteners are near the low-center of the back. A second variation shortens the U shape, 11, and lengthens the two end ends of the tube 13 and 14 so that the fastener is located over the user's chest, perhaps in front of his heart. Yet a third variation is to reverse the second variation front to back so that the fasteners are near the center of the user's back. For a person of average build, a suitable length of the tube is eight feet. Other suitable lengths are in the range six to ten feet. Yet another suitable range is four to twelve feet. Two sizes, three sizes, four sizes, five sizes, or six sizes may be offered.

Embodiments may be offered in different lengths for users of different builds. Alternatively, the tube may be shortenable by the user. Alternatively, the fasteners could provide adjustment to improve fit. For example, a fastener at one end of the tube could slide on the tube to a desired position. As another example, a fastener similar to belt buckle could be used to select a desired hole among a plurality of holes of the tube.

There are numerous embodiments of one or more fasteners. A fastener might be a single component, as far as the user is concerned, permitting three entry points. The entry points may be similar to a seat belt half-buckle, as shown in FIG. 5B. In one embodiment of the fastener there are two components. The first component accepts the tube ends 13 and 14, then accepts the second component 15, which is attached to the tube (it may slide on the tube) near the tube's midpoint. This configuration is visible in FIG. 1.

Embodiments may employ fastener mechanisms similar to car seat belts, in including child-seat restraints, and car racing seat belts and harnesses, such as are well known in the art.

Figure 3A:
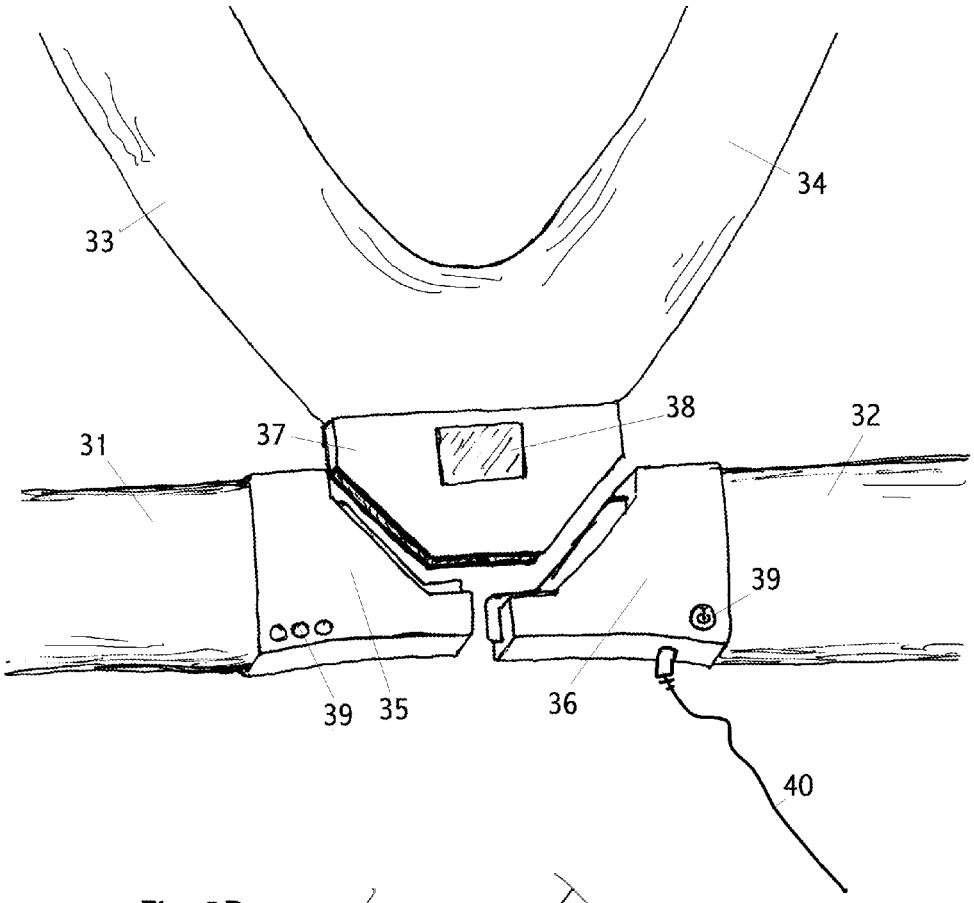
FIG. 3A shows a sketch of one embodiment of the fasteners.

Another embodiment of the fasteners is to provide three components. The first two components are attached to the tube ends, 13 and 14. These two components attach to each other. A third component, 15, then attaches to the joined 13 and 14. This configuration is shown in FIG. 3A.

One embodiment uses magnets in the fasteners. One suitable implementation uses rare earth Neodymium magnets, such as a NdFeB N42, as bars, ¾ inch by ¾ inch by 2 inches located in each component of the fastener.

Yet another embodiment of the fasteners uses webbing placed through webbing fasteners. Such fasteners are well known in sporting equipment, sports harnesses and mountain climbing gear, and may be found described in patent applications US2008/0189917, EP2036451 and EP0968374, for example.

Yet another embodiment of the fasteners uses hook and loop fasteners, such as Velcro®.

Yet another embodiment of the fasteners uses carabineers.

Yet another embodiment uses a hook on one end, and either a hook or a ring on a second end. Yet another embodiment uses interlocking rings.

Figure 2:
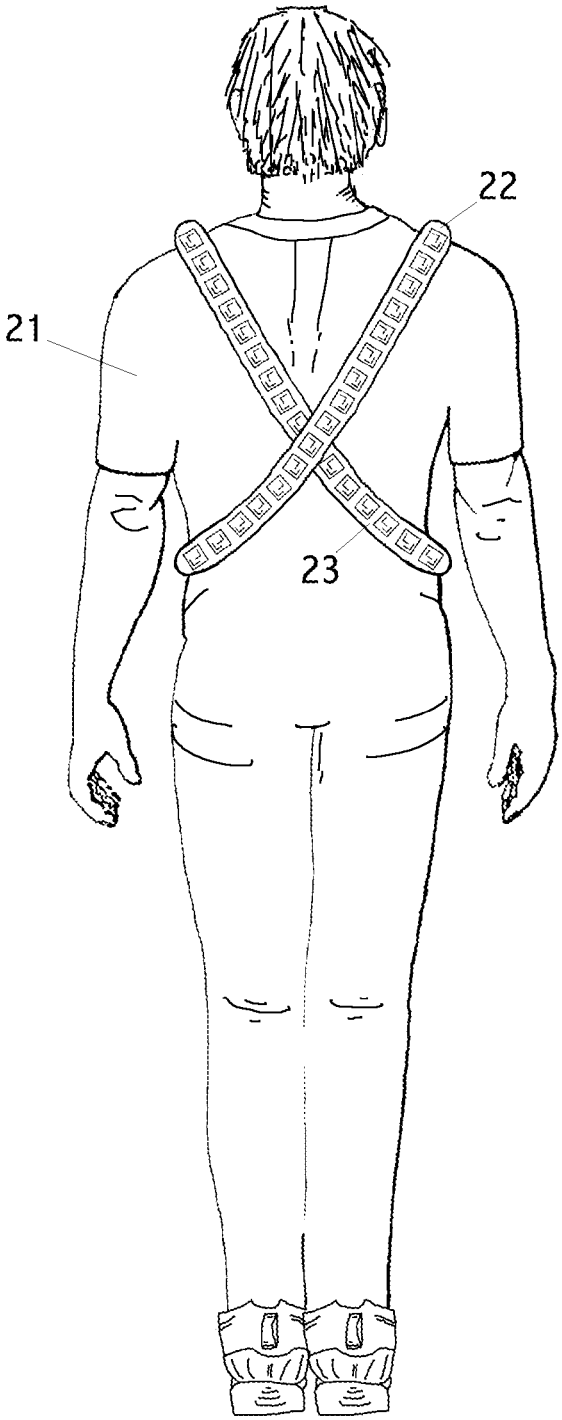
FIG. 2 is an exemplary view of the invention as a rear view of a person.

Turning now to FIG. 2, we see a back view of the first wearing configuration described above, on a standing user facing away from us, 21. The two diagonal portions of the tube of the back of the user are visible, 22 and 23.

A question may arise as to proper fit. The best fit is the one comfortable by and selected by the user, based on the user's preference for snugness v. the ability to move freely in his activity. Typically, being able to easily place one hand flat between the tube and the torso while the user is in position on his conveyance, and not observing any slop or gaps between the belt and the sides of the user at the waist, indicates a suitable fit. The portions of the tube over the shoulders should not slip off. Generally, the user should be able to lift his arms to horizontal.

In FIG. 3A we see a different embodiment of fasteners. This embodiment combines a controller and power source within the fastener shell. In this embodiment, the two ends of the tube, 31, and 32, are permanently or removably attached to shells, 35 and 36 respectively, that provide both a fastening function and at least a portion of the controller function. Although 35 and 36 are shown as visibly distinct, an alternative embodiment, not shown, implements the two portions 35 and 36 as a single monolithic shell. At least one of the shells, 35, 36 or 38, also contains user-replaceable or user-rechargeable batteries, in this embodiment. The midsection of the tube, the length between 33 and 34, is secured to the other two fasteners with fastener 37. Fastener 37 may be movable on the tube, or at a fixed position on the tube. In some embodiments, the tube is split in half, with each half exiting from fastener 37, such as 33 and 34. This embodiment is not shown. A release button is provided, 38, that releases all three shells: 35, 36 and 37.

In FIG. 3A we see the tube extending away from the central fastener shell 37 as 33 and 34, respectively. Thus, end 32 is the end of tube segment 33 and 31 is the end of tube segment 34, when the device is worn as shown in FIGS. 1 and 2.

In FIG. 3A we also see some buttons, 39, for the controller. These buttons may be used to select a light sequence, or to create, edit, or delete light sequences. In one embodiment, three buttons (such as shown on shell side 35) select color, such as red (R), green (G), and blue (B), where multiple buttons may be held down to indicate additional colors, and all three buttons held down to indicate white. Two buttons, such as shown on shell side 35, may select the function, such as start, stop, pause, or select a sequence. One embodiment provides for an external power source, such plugging into a motorcycle. An optional, removable power cable 40 is shown, Power from the controller to the light-emitting strip may be via one end of the tube, both ends of the tube, from the center of the tube, or from any combination.

A convenient embodiment is having the controller and at least one fastener integrated, as shown in FIG. 3A. Other embodiments use a separate controller and fasteners. A convenient embodiment is having electrical connections included as part of a mechanical fastener. One example is shown in FIG. 5B. However, the electrical connections from the controller to the light-emitting strip may be separate from the fasteners.

As one trained in the art appreciates, a large variation of controller implementations is possible.

Figure 3B:
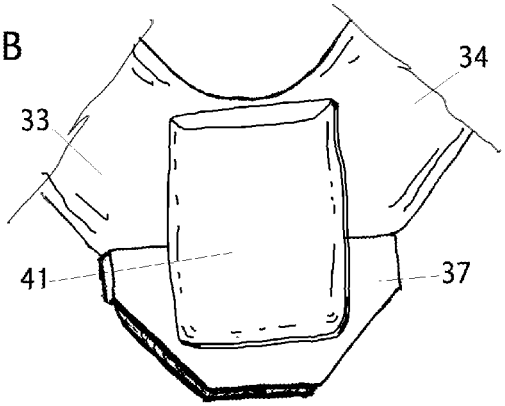
FIG. 3B shows a detail of an embodiment of a pocket for a personal electronic device.

FIG. 3B shows a detail view of one embodiment of a properly sized sleeve, pocket or clip for a personal electronic device, attached to a fastener or to the tube. Here we see a fastener, 37, at the midsection of the tube, 33 and 34. The pocket is 41. This embodiment has the advantage of providing a particularly convenient storage location—on the front of the torso—for a smart phone, for example, while also providing a user-interface and control functions for this invention.

Figure 4:
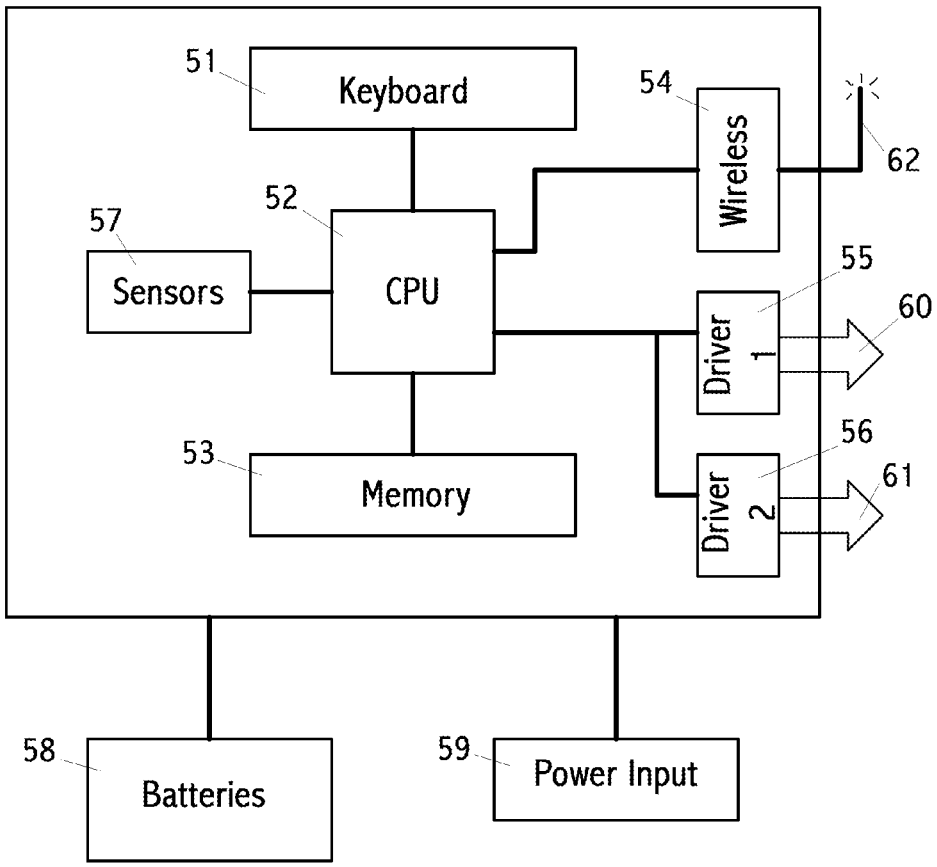
FIG. 4 shows a block diagram of one embodiment of the controller.

FIG. 4 shows one embodiment of a block diagram of a controller. The controller has a low-power CPU, 52, such an ARM processor; a keyboard and keyboard interface, 51; optional sensors, 57, such as an accelerometer or light sensor; local memory, 53, including RAM, program store, and illumination sequence store, which may use flash memory, and which may be fixed or removable; an optional wireless interface, 54, for one or more wireless protocols, such as Bluetooth™, WiFi, IEEE 802.11a/b/g/n/p, Near Field Communication (NFC) or other; and, if a wireless interface is used, an antenna, 62, which might be internal or external; one or more drivers for the light-emitting strip, such as LED drivers, here shown as two sets of drivers, 55 and 56; optional power input 59, and optional batteries, 58. Either the batteries or an external power input are required. In one embodiment solar power may enter the controller via the power input, 59. In another embodiment the power input connects to a power connector on a motorcycle. In another embodiment, the power input connects via a USB mechanical connector to a device configured to provide USB-compatible power. The illumination drivers 55 and 56, in this exemplary drawing, connect via two connectors or cables 60 and 61 to the light-emitting strip. Two cables can be advantageous because the light-emitting strip may be driven from either end, for example, or from the middle outward in two directions, or from both the middle and ends. Two sets of drivers may have the advantage of smaller drivers, or the advantage of smaller cables, or the advantage of lower voltage drop within the light-emitting strip or the advantage of increased reliability in the case that a first electrical path including driver, cable, connector, and a portion of the strip were to fail, that some illumination (or perhaps all) is then provided by the second path. As discussed elsewhere herein, the electrical connectors from the driver or drivers to the light-emitting strip may be integrated with one or more fasteners. At least one driver is required. Batteries, if used, may be user-replaceable, or user-rechargeable, or both. NiMH or Lithium batteries are suitable. So are alkaline batteries, such as three AA batteries.

The controller may communicate with the strip's electronics via an infrared link.

Figure 5A:
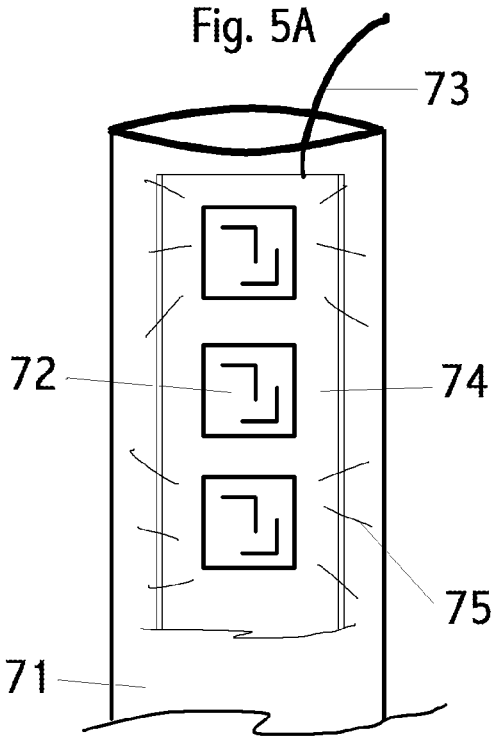
FIG. 5A shows a detail of one end of the tube with exemplary illumination elements.
Figure 5B:
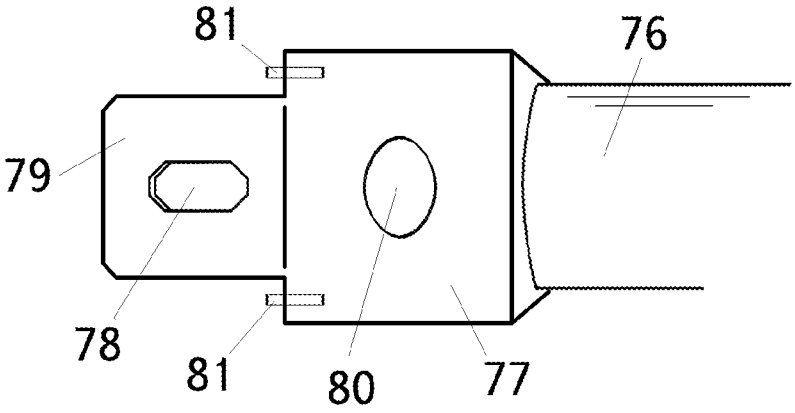
FIG. 5B shows a detail of one embodiment of one end of a fastener.

FIG. 5A shows a detail of one embodiment of the end of the light-emitting strip. 71 is the light-transmitting tube. The tube 71 may be transparent, translucent, or have holes for light. 74 is the light-emitting strip, adapted to fit inside the tube 71, neither so loose as to flop around in use, nor so tight as to make insertion into the tube 71 during manufacture difficult. The tube 71, if made out of transparent PVC, may be flattened into an elliptical cross-section in order to aid in the placement of the light-emitting strip, 74, therein. The natural springiness of the tube 71 then helps to hold the light-emitting strip 74 in place. 75 shows light being emitted by the light-emitting elements on the strip, such that from a typical distance when the device is in use, the light appears to illuminate the tube the entire length of the tube, except of end caps and fasteners. 73 show a power cable to the light-emitting strip. Suitable methods of powering and controlling the light-emitting strip are discussed elsewhere herein.

A typical distance means the distance that another driver sees a motorcycle rider, at a distance such that the other driver may safely avoid the motorcycle rider.

No fasteners are shown in FIG. 5A, although in many embodiments a fastener is attached or associated with both ends of the tube, 71. A suitable flexible, light-emitting strip, 74, is "Waterproof 5M 16 FT RGB 5050 SMD LED Strip-Light 300 LEDS & Controller 24-key," available from Amazon.com, part number B00AFNYUFI, as well as from other vendors. This strip may be modified, such as shortened, as part of the construction of this invention. The controller may be modified or replaced, as part of the construction of this invention. A suitable tube, 71, is transparent PVC tubing, eight feet long, ⅞-inch diameter, available from many sources such as McMaster-Carr, part number 5233K69. Suitable end-caps are marine eye ⅞-inch caps, available from many sources, such as First Choice Marine, part number, which may be glued with PVC-compatible glue on the tube ends. A suitable controller is from the same component described above for the light-emitting strip. More than one light-emitting strip may be placed in the tube.

Power wiring to the light-emitting strip, 73, from either a controller or from strip electronics may have multiple forms. One form comprises four wires: common, red (r), green (b), and blue (b). The controller provides appropriate current, which may be pulsed, between each of the color-wires and the common. Varying the current, or the duty cycle of pulses, effects a brightness change on the corresponding color light emitting elements on the strip. Colors other than red, green, or blue are achieved by turning on more than one color at a time. More complex wiring permits patterns and sequences where not all light emitting elements, 72, of one color are illuminated at the same time, as one trained in the art appreciates. Some drive electronics may be integrated with the strip. Suitable elements within the strip, 72, include tri-color surface mount LEDs mounted on a flexible circuit board, at a density of 15 LEDs per linear foot. Another suitable density is 10 to 20 LEDs per linear foot. Another suitable density is 3 LEDs to 200 LEDs per linear foot.

In one embodiment a flexible strip has light emitting elements on one surface and the tube is such that light is emitted radially around the tube, although some portions may emit more light than other portions. For example, the tube may be translucent or partially reflective.

In one embodiment a flexible strip has light emitting elements on both surfaces.

In one embodiment, a flexible strip has light emitting elements on one side, but some such elements provide light primarily in a first direction and other such elements provide light primarily in a second, different, direction. For example, the strip may have holes, with LEDs mounted so that light passes through the holes in the strip. Also, right-angle light emitters may be used.

In one embodiment, a flexible strip is twisted, corkscrew like, so that even though the light-emitters on the strip provide light in a primary direction, the tube as a whole emits light in all radial directions.

In one embodiment, two flexible strips are used, back-to-back. This is describe below, for FIG. 8.

FIG. 5B shows one embodiment of part of a fastener. This fastener resembles a seat belt in appearance and operation. The tube, 76, is permanently attached to a shell, 77. Extending from the shell 77 is a tang, 79. The tang, 79, has a hole, 78, which is used by the mating portion of the fastener (not shown) to engage the tang. A release button, 80, is provided. Alternatively, such a release button may be on the mating portion of the fastener. A unique feature of this embodiment is the inclusion of power or signal wires integral to the fastener. This is shown as two electrical connectors, 81. The advantage of this embodiment is that electrical connection and disconnection can be made at the same time, with no additional thinking or effort, as the mechanical connection of the ends of the tube when a user places this embodiment on his body. Note that unlike a seat belt, this fastener has a far lower requirement for strength. As one in the art appreciates, there are many suitable fasteners and many suitable electronic connectors.

Figure 6:
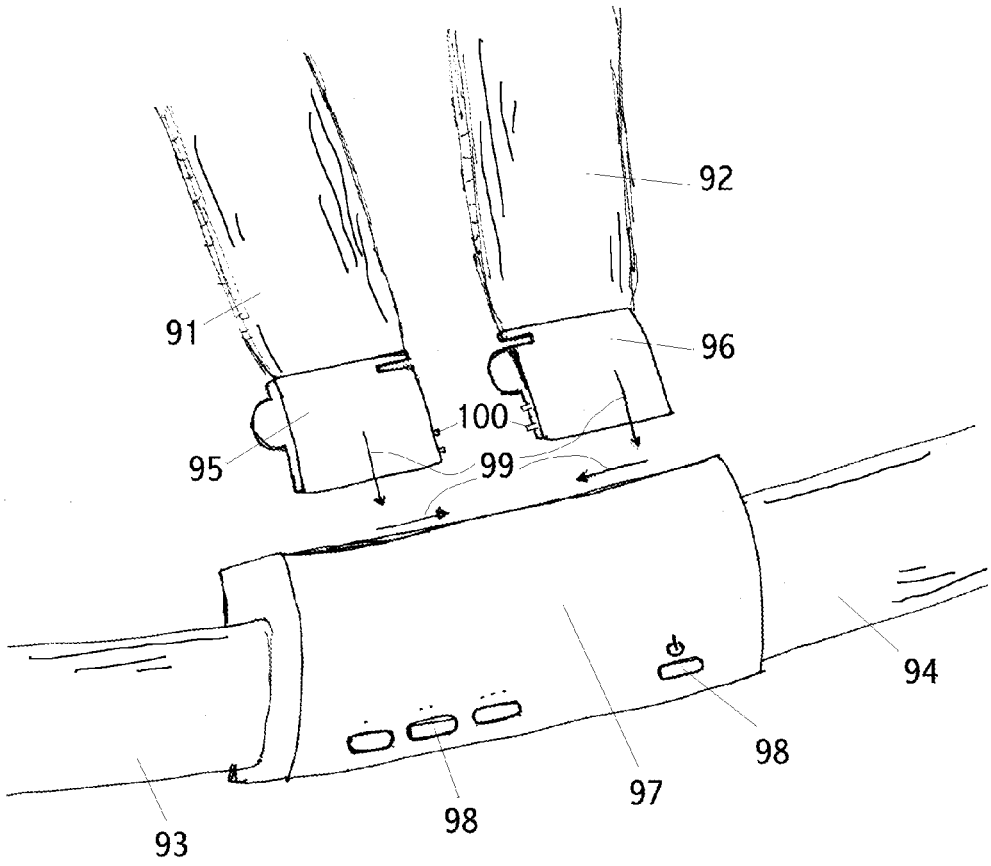
FIG. 6 shows an alternate embodiment of fasteners integrated with the controller.

FIG. 6 shows an alternate embodiment of fasteners. Here, the middle of the tube is in the lower part of the Figure, portions 93 and 94. Note that either this fastener configuration of the one shown in FIG. 3A may be used upside down, or at the back of the user. The ends of the tube 91 and 92 are attached to fasteners 95 and 96, respectively. These are snapped into the shell 97 at the middle of the tube, between 93 and 94, with motions shown by the arrows 99. These motions provide mechanical fastening and electrical connection, shown via the electrical pins 100. Controller buttons are shown 98. Shell 97 may comprise all or part of the controller; may comprise batteries, may comprise input for external power via a cable (not shown in this Figure). Shell 97 may be fixed or it may slide on the tube, between 93 and 94.

In one embodiment a user or distributor may shorten the tube at one end, such as at end 92. If power enters the light-emitting strip from the center, 93 and 94, or from end 91, then end 92 may be shortened appropriately, such as at cut or snap points provided for this purpose, without having to rewire or otherwise modify the invention. The combination of being able to shorten the tube and slide the shell 97 along the mid-point provides for an easily adjustable size (to a smaller size) of this embodiment.

Figure 7:
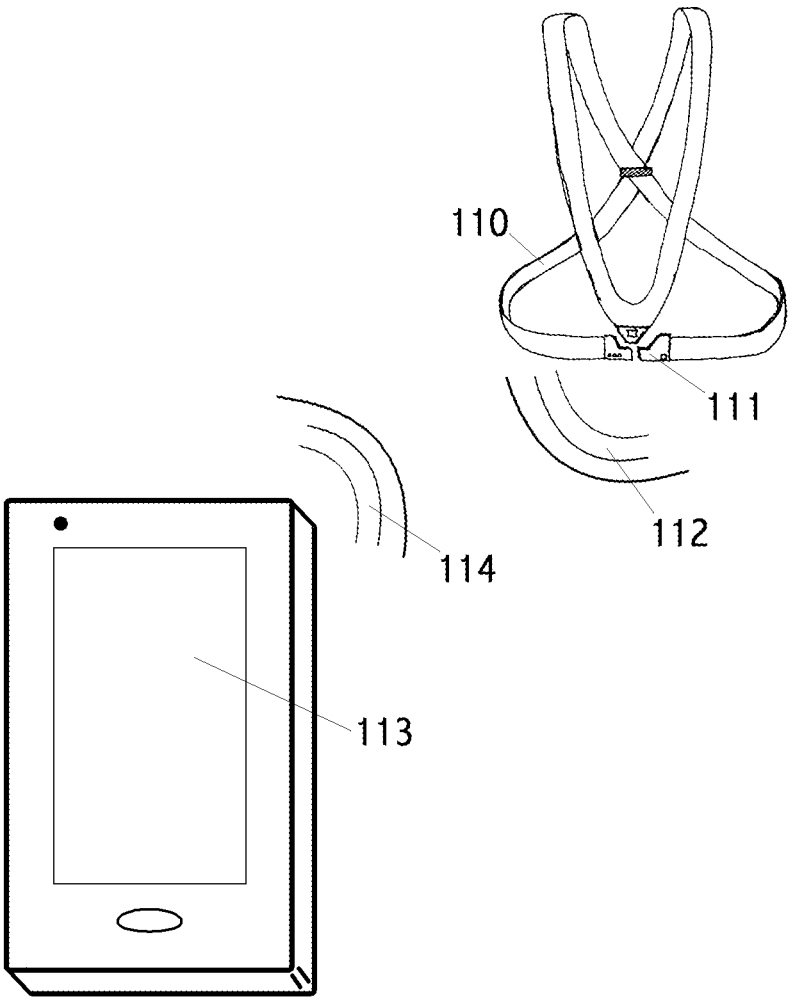
FIG. 7 shows the use of a personal electronic device to control the invention.

FIG. 7 shows the invention, 110, being controlled by a personal electronic device, such as a smart phone, PDA, tablet, credit-card computer, or similar device, 113. The preferred interface from the personal electronic device to the controller is wireless, such as Bluetooth™, WiFi, IEEE 802.11, or Near Field Communication (NFC), shown as 112 and 114. Alternatively, infrared may be used. The wireless interface in the invention may be attached to or integrated into one or more fasteners, 111, or may be part of a separate controller (not shown in this Figure). Other communication methods include wired, optical and cellular data. An app on the personal electronic device typically provides the functionality for these purposes. The personal electronic device provides the user interface and the communications to the controller. It may also provide some memory functionality, such as a store of different illumination sequences. It may also provide communication to other, similar devices either directly or via additional personal electronic devices. Such communication may be used to synchronize multiple devices or to operate them cooperatively, or to have one user control a plurality of devices. It may also provide sensors, such as GPS, a clock, an accelerometer, a thermometer, a camera, or a microphone, or any combination of these sensors. It may also provide access to a map database or navigation capabilities. These sensors are useful for altering sequences responsive to an environmental parameter. For examples: a first light sequence may used when a motorcyclist is braking, such a multi-colored flashing and apparent movement at a high rate; a second light sequence may used when a motorcyclist is turning, or about to turn, such a blinking all red; a light sequence may used in the daytime may be different than a light sequence at night. Here, "sequence" refers to variations in brightness, color, time sequences, and position sequence. A position sequence refers to the plurality of LEDs (or other illuminators) within the light-emitting strip illuminating differently. Such different illuminations might be random, a pattern such as: on/off/on/off, or apparent motion along the length of the tube, other variations along the length of the tube and time.

Functions that might be performed while the user of an open conveyance is not operation, by an app on the personal electronic device, in FIG. 7, include: creating a new sequence; importing a sequence from another source, such as from a friend or download; editing a sequence; deleting a sequence; loading one or more sequences into the controller; setting up a sequence such that it is responsive to one or more sensors or other dynamic, real-time input; observing battery life and other status of the invention; and managing these resources and features. Functions that might be performed while the user of an open conveyance is driving, by an app on the personal electronic device, in FIG. 7, include: turning the device on and off; pausing a sequence; selecting an operating mode; selecting a sequence; interfacing to other devices of this invention, and other functions. Note that access to some functions might be split between the personal electronic device and the controller. For example, the functions above for a "non-operating" user are implemented on the personal electronic device while the functions for an "operating" user (i.e., while driving) are implemented on the controller. Some functions might be available from either the personal electronic device or the controller. Note also that some sensors, such as an accelerometer, may be in the controller.

Figure 8:
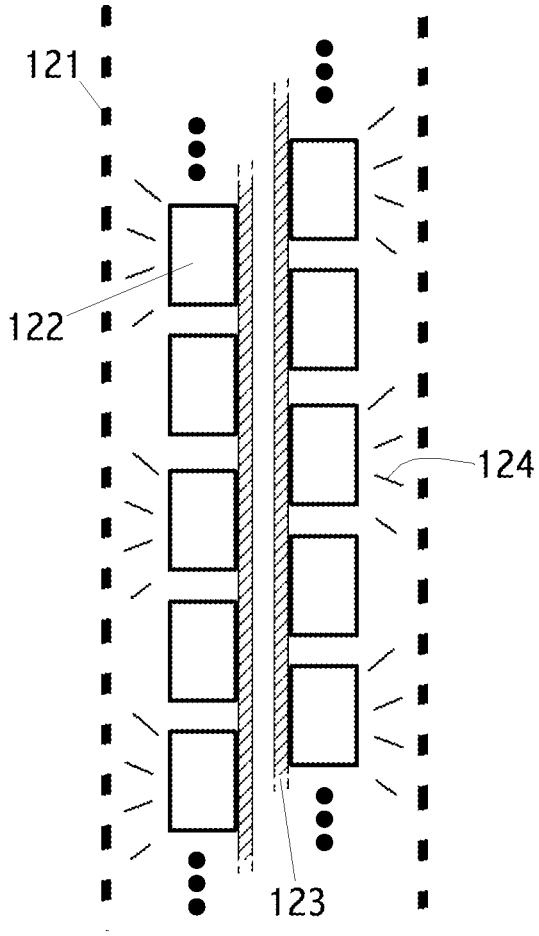
FIG. 8 shows a detail of a tube with two back-to-back light-emitting strips.

FIG. 8 shows an embodiment of a detail of one section of the tube with two strips, or one strip folded in half, back-to-back inside the tube. 121 is the cross-section of the tube, which is shown as a dotted line to emphasize the light-transmissive nature of the tube. 122 is an exemplary light emitter, such as a tri-color, surface-mount LED, mounted on a flexible circuit board 123. Two such flexible circuit boards are shown in the figure, each with a line of exemplary LEDs. Alternatively, what is shown may be two portions of a single folded strip. (The fold is not shown in Figure). Ellipses are used to show that the flexible strips continue for the length of the tube except for fasteners and any integrated electronics or batteries within the tube. 124 shows a light pattern from some of the LEDs. Note that, as shown in the Figure, light is coming from every other LED, on both strips. This is an example of an illumination pattern or sequence.

As one trained in the art appreciates, there are many other ways to design, build and install one or more light-emitting flexible strips in a flexible tube. More than two strips could be used, or one strip could have emitters, such as LEDs, pointing in multiple directions. A single strip could be twisted, corkscrew like, so that light exits the tube in all radial directions. A strip may be folded once or more than once inside the tube.

Figure 9:
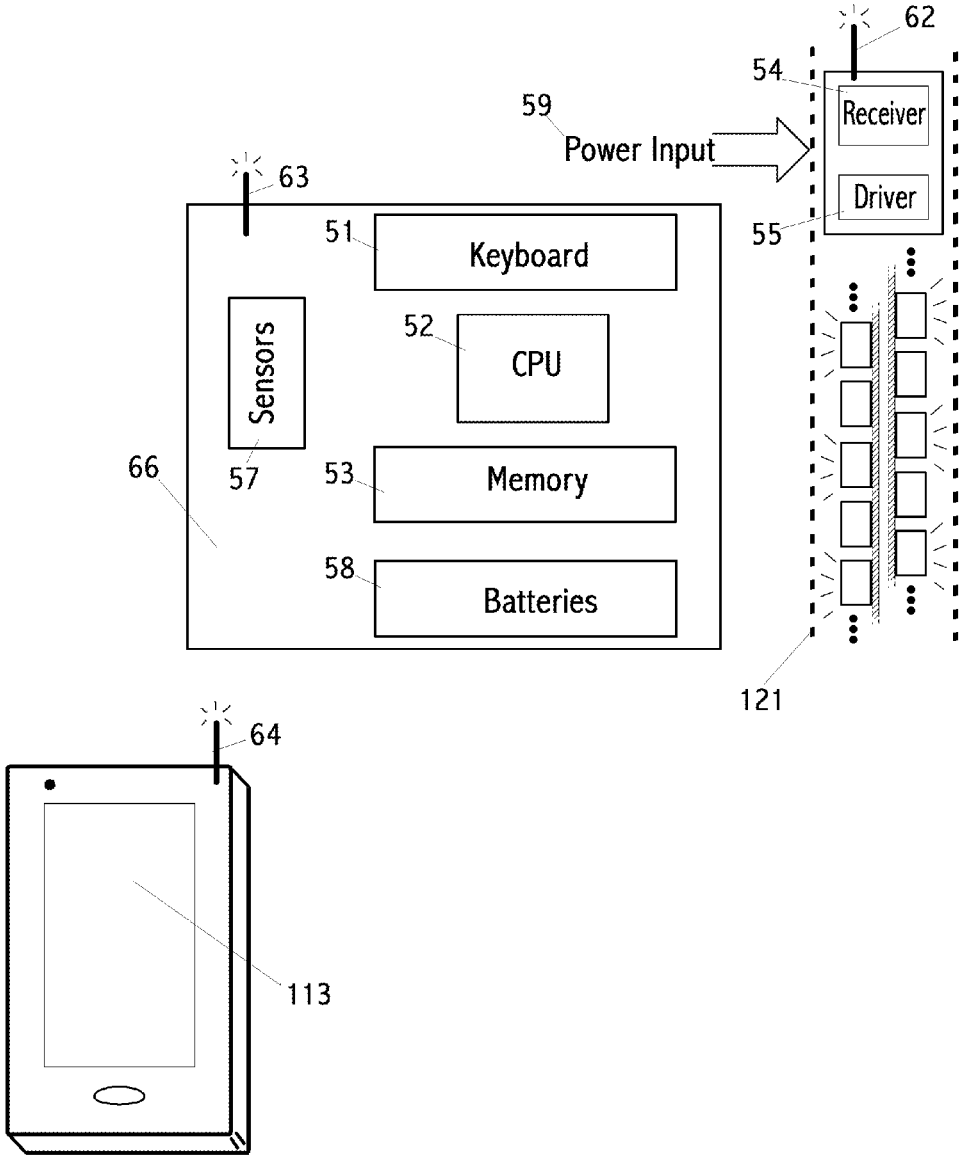
FIG. 9 shows an embodiment wherein the controller functions are divided into three physical modules.

FIG. 9 shows an embodiment where the controller functions are divided into three physical modules. Here, one portion is inside the tube, 121. This portion includes a wireless receiver 54 and drivers 55 for the optical elements. A second portion, 66, comprises a CPU 52, memory 53, internal batteries 58, optional keyboard 51, optional sensors 57, and a wireless interface 63, which may use a range of technologies, such as optical or radio, as discussed elsewhere. A third portion of the controller for the device resides in a personal electronic device 64, which uses its wireless interface 64 to communicate to the first portion, second portion, or both. The personal electronic device may provide software, memory, stored illumination sequences, a user interface, sensors, Internet connectivity, and connectivity to other devices.

In one embodiment, where operation is at least partially controlled by a personal electronic device, the personal electronic device may communicate with other personal electronic devices which in turn control devices of this invention worn by other users. Such communication may be direct, such as via Bluetooth™ or an ad hoc wireless network, or through the Internet or through cellular data. In this embodiment the illumination sequences of at least one other device are responsive to at either a sensor, stored sequence, or the illumination sequence of the present device. For example a lead biker's pattern could be duplicated, mimicked, or used to provide motivation for other biker's illumination patterns. All bikers in a group could have the same pattern, or all have unique patterns, or one pattern could be repeated from biker to biker, in turn, as non-limiting examples. All bikers might have the same pattern until some unusual condition caused one biker's pattern to be different. Such a difference would be immediately noticeable by all the bikers. A lead biker could display one color, while a trailing biker a second color, while bikers in the middle display a third color. In this way, the bounds of a group of bikers would be easy to see. My means of GPS or other sensors, such color assignment could be entirely automatic. This embodiment is not limited to bikers. It is equally suitable for bicyclists, skiers, and users in other sports and open conveyances. It is equally suitable for a group of people, such a family or friends, in a crowded environment, such as at transportation, a fair, a concert or a sporting event, so that they may locate each other more easily. Embodiments of this type may be effectively controlled via one or more apps running the users' personal electronic devices. Embodiments of this type include: (a) communicating devices; (b) a system of communicating devices; and (c) a method of communicating among a group of user using devices of this embodiment.

In one embodiment the tube may be shorted by an end customer, a retailer, or a distributor, for example, without the use of specialized tools. For example, a fastener may be removed from an end of a tube that has no protruding wires or an attached controller, the tube cut with a knife or scissors, then the light-emitting strip snapped off at a perforation provided for this purpose, then the fastener re-attached to the now-shortened tube.

All examples are sample embodiments. In particular, the phrase "invention" should be interpreted under all conditions to mean, "an embodiment of this invention." Examples, scenarios, and drawings are non-limiting. The only limitations of this invention are in the claims.

ADDITIONAL DISCUSSION ON CLAIM TERMINOLOGY

Text below provides additional non-limiting support for claims. Additional discussion on claim, word, and phrase usage and meaning is provided elsewhere herein.

A tube may be circular or elliptical in cross section, or rectangular, or another cross-sectional shape. A suitable material is clear polyvinyl chloride (PVC). A suitable diameter is ⅞ inch. Suitable diameters are ¾ inch to two inches. Alternative suitable diameters are ½-inch to four inches. For a person of average build, a suitable length of the tube is eight feet. Other suitable lengths are in the range six to ten feet. Yet another suitable range is four to twelve feet. Two sizes, three sizes, four sizes, five sizes, or six sizes may be offered.

Visibility is a reference to the safety of a driver, operator, rider, passenger or user of an open conveyance, particularly but not exclusively so that other vehicle operators and other users of open conveyances may safely see the user wearing the device under operating conditions, including daytime, dusk, and night, so as to avoid hitting the user or otherwise impairing the operation of the user. Such visibility may be reasonably compared the visibility provided by prior art illuminating safety equipment, such as a car taillight or a wearable bicycle light. Detailed specifications for such prior art examples are available in the literature.

The flexibility of the light-emitting strip, or strips, is such that the device may be used as described. That is, it may be draped over the shoulders of the user, crossing in the back of the user, with the ends and mid-point secured in the front of the user.

The light-transmissive tube may be transparent, such as clear PVC, or may be translucent, or may be partially reflective, or may have visual holes for light, or combinations thereof such that light from the light-emitting strip or strips exits the tube radially. One embodiment uses a single light-emitting strip with translucent or partially reflective tube such that the tube emits light in the direction of the back of the strip, even while the majority of the light from the strip is emitted from the front of the strip. The light-transmissive tube may comprise light-pipe or light-directing elements. It may comprise elements that direct, re-direct, reflect, diffract, focus or de-focus light, including elements that produce multiple colors such as diffraction gratings, and elements that produce 3D effects such as holograms.

The electronic controller provides several functions. This functionally may be split among multiple physical pieces, in some embodiments. One function is actually driving the light-emitting elements, such as LEDs, OLEDs, electronic flash, or other devices. One function is power conditioning: adapting the power input to the appropriate voltages, currents, pulses, safety limits, to meet the specific requirements for controller, light-emitting strip and other electric and electronic elements of this invention. One function is providing a memory for illumination sequences. One function is providing a user interface. One function is providing the computational core for the controller. One function, in some embodiment is providing wireless or other remote control or communications features.

All of these controller functions might be implemented in a single physical module. Or these functions might be split between two physical modules. For example, power conditioning and the drive electronics might in a module attached to the light-emitting strip, or may be provided on or in the light-emitting strip itself. The user interface and memory might be implemented in a small, handheld "remote" that provides a keyboard, and communicates via infrared, Bluetooth™ or IEEE 802.11 to the a receiver on, in, or next to the light-emitting strip.

Yet another embodiment of the controller splits the functionality into two physical modules, but in this embodiment a personal electronic device, such as a smart phone, provides the user interface and at least some memory.

Yet another embodiment of the controller splits the functionality into three physical modules: one on, in or attached to the light-emitting strip; an intermediate modules; and a user-interface module.

Each of the various physical modules may be powered separately. Or, one module may feed power to another module. For example, primary power, from either a mobile source such as a battery pack, or provided externally, such as from a motorcycle, may feed a controller, which in turn provides power to the light-emitting strip. In some embodiments the batteries are internal to the physical modules.

When we refer to a second light-emitting strip, which might be back-to-back in the tube with the first light emitting strip, being controlled by the controller in cooperation with the first light emitting strip, we mean that the two strips are controlled together so that any light sequence uses both strips operating cooperatively such that the user does not need to be concerned with the mechanical implementation of the embodiment comprising two separate light-emitting strips. In one embodiment, both light-emitting strips are driven equally. By "two light-emitting strips," we also refer to an embodiment with a single strip, folded in half, with the two halves back-to-back in the tube.

An illumination sequence refers to any sequence in time, space, color, or in any combination. This term also refers to "no sequence" per se, such as on steady white or on steady red. Another sequence may provide the appearance of motion along the length of the tube. Sequences may include flashing. Sequences may include sub-sequences.

A ring means that the two ends of the tube are joined. The fasteners are not necessary at the precise end of the tube. For example, in much the same way that a belt is adjustable by selecting a fastening point from a set of fastening points near one end of the belt, a fastener "at" or "near" a given end of the tube refers to an operational fastening sufficiently close to the end of the tube such that the tube performs the described function and that any left over end of the tube, past the fastener, does not significantly interfere with the operation of the device on a user. In one embodiment, the adjustment length for a fastener near an end of the tube is from zero to up to one quarter the length of the tube.

The midpoint of the tube, or "near" the mid-point of the tube is such that (a) the tube fits on the torso of the user comfortably. The user may wish to have the fastener off-center on his torso, or may wish one side of the device to be looser on his torso than the other; and (b) if a fastener near one end is set to be, say eight inches from the of the tube, then the desired midpoint of the tube shifts by four inches such that the two in-use portions of the tube are equal. Thus, "near" is defined such the device operates as described.

When we speak of light being emitted from the tube continuously for its entire length, we mean the entire length except for areas under, hidden by, or adjacent to one or more fasteners, or portions of the tube that are occupied by power, control or drive electronics, or batteries. Such excluded regions are no longer than six inches each. Some areas of the tube may be covered by a label, or by other small utilitarian or decorative elements, and thus light may not be emitted through such an element. Such elements should obscure not more than six inches each of tube length. Note that a fastener in the middle of the tube similarly may block some light from the tube, as could a pocket for a personal electronic device, and thus these regions are excluded from the term, "continuously for its entire length."

A mobile power source may be a module comprising batteries, or another stand-alone power source. Such batteries may be rechargeable, replaceable, or not. The module may be the same physical module that is used for another purpose, such as housing the controller, or the module may be part of, or inside of, the tube.

When we say that the device, the invention, the tube, or one or more light-emitting strips are powered from a particular source, or via a particular element, we mean either powered directly, or indirectly via power conditioning circuitry, or indirectly through the controller or another element of the invention. For example, LED driver IC's may effectively provide the power to produce the illumination from this invention. The LED driver IC's may take their input power from a power supply, which in turn is provided power by batteries or via a cable and plug, such as from a motorcycle. There may be more than one power source in operation at once.

By waterproof we mean that the device may be used in the rain by a user without permanent damage. While in the rain, it operates as described.

By abrasion resistant we mean that for at least half of typical falls by a motorcycle or bicycle rider (as the user) from his conveyance, that the tube and the enclosed light-emitting strips do not suffer permanent damage of a nature to prevent their usable operation. For example, the tube may sustain major scratches, but does not break apart or become non-operational. A fastener may open or a wire may become reparably open.

When we say that the tube may be interrupted by a fastener near the mid-point, we mean that visible light may not exit the tube where the tube passes through or is behind such a fastener. We also mean that both of the light-emitting strips, or the tube itself, or both, may be physically separated into two halves of the whole tube. Nonetheless, the appearance and operation of the invention as a whole functions as if the tube were a single element with a portion visually obscured by the mid-point fastener.

When we say that the sequence of illumination is responsive to an accelerometer, that sensor may be a component of the invention, or may be in a separate device, such as a smart phone, communicating with this invention, or that sensor may be in or on the open conveyance, such as a motorcycle. An accelerometer is able to provide output to indicate, directly or indirectly, a variety of specific activities, such as braking, turning, accelerating, changing lanes, stunts, or falling. The accelerometer, in conjunction with software, memory, map data, or other sensors, may be able to provide information related to the route of the user, and thus may be able to predict, sometimes with excellent precision, future actions of the user, such as making a turn at an intersection. The accelerometer may be able to identify activities such have having a passenger on board, or gunning the engine. I may be able to identify starting and stopping a bike, or parking, mounting, or dismounting. Thus, when we say responsive, we mean responsive to both the raw output of the accelerometer or sensor, and also the detection and response to any combination of the activities stated herein, in a non-limiting meaning. In one embodiment, if a user falls, a particular illumination sequence is enabled with a priority over any other selected sequence.

The term sensor includes accelerometers, magnetometers, thermometers, touch sensors, tilt-sensors, moisture detectors, microphones, cameras, video input, radio signal sensors, and other sensors as those in the art appreciate. The term sensor in particular includes GPS signals and the signals from similar satellite navigation systems. The term sensor also in particular includes signals from vehicle-to-vehicle navigation systems.

In this way it is possible to produce a wide range of illumination patterns matched to specific current and future behaviors of the user.

When we say that the tube is the "primary structural element" of the invention we mean that it is the tube, and the contents of the tube, that determine how the invention drapes on a torso. The term "primary structural element" does not include a controller or controllers, nor the structural part of one or more fasteners.

When we say that the invention is free of garment cloth we mean that it is not an article of clothing such as a jacket or vest. It is free of cloth or cloth-like materials whose primary purpose is provide the substance of an article of clothing. This limitation, "free of garment cloth," excludes such incidental elements such as a label or included cleaning cloth, webbing-based fasteners, hook and loop fasteners, a personal electronic device pocket, and the like.

When we say the "illumination-mode," we meant that a power switch, if any, is set to the on-position or on-mode, and that the entirety of the device, including any embodiment of a controller or controllers, is set to an illumination-on mode. For example, a non-illumination-mode may be when the device is being programmed for illumination sequences, but all illumination is off. Such a mode might be called a "programming mode" rather than a "turned on mode." Similarly, there may a distinct, "standby mode."

A holder for a personal electronic device may be a pocket, sleeve, clip, sling, bag, net, or other holder or fastener adapted to a particular type or brand of a personal electronic device, or such a device generically. For example, one embodiment comprises two rubberized hook and loop straps to grasp a device of varying size and dimensions. A second example embodiment comprises a full or partial pocket, which may be adjustable, for a smart-phone, PDA or tablet. A third example embodiment is a stretchy net. A fourth example is a fitted mechanical clip.

Fastener elements may have a single release action that releases all connected fastener elements, such as a single mechanical push button, or may have separate releases for each fastener element, or may require a series of steps, such as for mountain climbing body harnesses.

DEFINITIONS

Ideal, Ideally, Optimum and Preferred—Use of the words, "ideal," "ideally," "optimum," "optimum," "should" and "preferred," when used in the context of describing this invention, refer specifically a best mode for one or more embodiments for one or more applications of this invention. Such best modes are non-limiting, and may not be the best mode for all embodiments, applications, or implementation technologies, as one trained in the art will appreciate.

May, Could, Option, Mode, Alternative and Feature—Use of the words, "may," "could," "option," "optional," "mode," "alternative," "typical," "ideal," and "feature," when used in the context of describing this invention, refer specifically to various embodiments of this invention. Described benefits refer only to those embodiments that provide that benefit. All descriptions herein are non-limiting, as one trained in the art will appreciate.

What is claimed is:

1. A device of manufacture to provide enhanced visibility to a user of an open conveyance, comprising an elongate, flexible, light-emitting strip;

an elongate, flexible, hollow tube, wherein the tube encloses the light-emitting strip and wherein the walls of the tube are light-transmissive;

an electronic controller for the light-emitting strip; wherein the controller is adapted to cause the light-emitting strip to produce a sequence of illumination in different colors;

at least one releasable fastener;

wherein the tube is adapted to be placed around the torso of the user such that it passes around the torso and over at least one shoulder;

wherein the at least one releasable fastener holds the tube in place on the user.

2. The device of claim 1 wherein:

the at least one fastener fastens the two ends of the tube such that the tube forms a ring.

3. The device of claim 1 wherein:

wherein the tube is adapted to pass over both shoulders of the user and cross in the back of the user, a "first wearing configuration".

4. The device of claim 3 wherein:

the light-emitting strip produces light such that, for at least one sequence of illumination, the tube emits illumination continuously for its entire length except at the fasteners; and at least some of the emitted illumination is visible from all sides of the user;

wherein the device is adapted to be visible by vehicle drivers, in the daytime, at a distance suitable to enhance the safety of the user wearing the device.

5. The device of claim 1 further comprising:

a power plug;

wherein the light-emitting strip is adapted to be powered by power transmitted via the power plug.

6. The device of claim 1 further comprising:

a power plug and a mobile power source;

wherein the device is adapted to accept as input power either power from the mobile power source or power transmitted via the power plug.

7. The device of claim 1 further comprising:

a second elongate, flexible, light-emitting strip;

wherein the tube encloses the second light-emitting strip;

wherein the controller is adapted to control the second light-emitting strip in cooperation with the first light-emitting strip;

wherein the first and second light-emitting strips are disposed back-to-back in the tube.

8. The device of claim 1 wherein:

the flexible, light-emitting strip is folded in half such that each half is disposed back-to-back inside the tube.

9. The device of claim 1 wherein:

the controller is adapted to change the sequence of light under control of the user while the user is using the open conveyance.

10. The device of claim 1 wherein:

the controller is adapted to be pre-programmed with an illumination sequence such that the pre-programmed illumination sequence operates while the device is worn by the user when the user is using the open conveyance.

11. The device of claim 1 wherein:

the device is adapted to be waterproof.

12. The device of claim 1 wherein:

the tube is adapted to be abrasion resistant to the enclosed light-emitting strip in the event that the user wearing the tube falls from the open conveyance onto the ground.

13. The device of claim 1 wherein:

the tube is interrupted near the mid-point of the tube by at least one fastener.

14. The device of claim 1 wherein:

the sequence of illumination is responsive to an accelerometer.

15. The device of claim 1 wherein:

the device comprises a wireless interface adapted to receive signals from a personal electronic device;

at least one sequence of illumination is responsive to the signals received from the personal electronic device and wherein the received signals are responsive to a sensor in the personal electronic device.

16. The device of claim 1 wherein:

the tube is the primary structural element of the device and the device is free of garment cloth.

17. The device of claim 1 wherein:

the at least one releasable fastener further comprises a holder for a personal electronic device;

wherein the holder is configured such that the personal electronic device is within reach of a user of this device while the user is using the open conveyance;

wherein the holder is further configured to hold the personal electronic device securely while the open conveyance is in operation;

wherein the device is adapted to receive signals from the personal electronic device, such that the personal electronic device functions as a user interface for the device.

18. The device of claim 1 wherein:

the at least one fastener is comprises three fastener elements: a first fastener element at a first end of the tube; a second fastener element operably near the second end of the tube; a third fastener element near the midpoint of the tube;

wherein the first, second and third fastener elements fasten together so as to hold the device on the body of the user.

19. A method of enhancing the safety of a rider of an open conveyance by the steps of:

programming the controller of claim 1;

placing the tube of claim 1 around the torso of the rider as described in claim 1;

turning on the device of claim 1;

riding the open conveyance.

* * * * *